United States Patent [19]

Schmit

[11] 4,165,023

[45] * Aug. 21, 1979

[54] FLUID CONTAINING AND DISPENSING STRUCTURE HAVING A DEFORMABLE FLEXIBLE WALL PORTION

[76] Inventor: Justin M. Schmit, 126 Sea Island La., Boca Raton, Fla. 33432

[ * ] Notice: The portion of the term of this patent subsequent to Feb. 28, 1995, has been disclaimed.

[21] Appl. No.: 817,816

[22] Filed: Jul. 21, 1977

[51] Int. Cl.[2] ..... B67B 7/28

[52] U.S. Cl. ..... 222/105; 222/183

[58] Field of Search ..... 222/105, 107, 131, 183, 222/569, 570; 220/460, 461, 462, 463, 465

[56] References Cited

U.S. PATENT DOCUMENTS

| | | | |
|---|---|---|---|
| 2,398,505 | 4/1946 | Pepin | 222/107 |
| 3,559,847 | 2/1971 | Goodrich | 222/107 |
| 3,938,707 | 2/1976 | Schmit | 222/183 X |
| 3,951,318 | 12/1974 | Costa | 222/569 |
| 4,076,147 | 2/1978 | Schmit | 222/105 X |

*Primary Examiner*—Robert J. Spar
*Assistant Examiner*—Fred A. Silverberg
*Attorney, Agent, or Firm*—Schroeder, Siegfried, Ryan, Vidas & Steffey

[57] ABSTRACT

The invention relates to a container comprising a fluid containing pouch having at least one flexible upper wall portion made of an extensible plastic material. The upper wall portion is connected to a dispensing neck by deforming the upper wall portion into an annular recess into the dispensing neck and locking the same therein with an annular locking collar which is press fitted into the recess. The dispensing neck includes a translationally extending flange portion which will cooperate with a sleeve to secure the dispensing neck in an aperture of a supporting carton. The pouch and a portion of the dispensing neck are preferably made of dissimilar materials having low gas permeation characteristics to prevent the seepage of oxygen into the fluids in the container.

19 Claims, 5 Drawing Figures

FLUID CONTAINING AND DISPENSING STRUCTURE HAVING A DEFORMABLE FLEXIBLE WALL PORTION

FIELD AND BACKGROUND OF INVENTION

The present invention relates to a container which includes a fluid containing pouch having a flexible upper wall portion to which is secured a dispensing member and more particularly to an improved container of this type having an improved pouch construction, a simple connection of the dispensing member to the pouch and a simplified means for connecting a pouch to a supporting carton.

Containers which incorporate flexible liquid containing pouches and having dispensing structures associated therewith or formed therein are old. Similarly, such pouches have been previously mounted in a supporting container. Examples of such prior constructions will be found in my prior U.S. Pat. No. 3,938,707, dated Feb. 17, 1976 and entitled FLUID CONTAINING AND DISPENSING STRUCTURE, and U.S. Pat. No. 3,995,773 dated Dec. 7, 1976 and entitled FLEXIBLE LIQUID CONTAINING AND DISPENSING DEVICE. The combination of a pouch and a supporting carton is also shown in my pending U.S. application Ser. No. 683,174 filed May 4, 1976 now U.S. Pat. No. 4,076,147 and entitled LIQUID CONTAINER AND METHOD AND MACHINE FOR MAKING SAME.

In the packaging of certain types of fluids or fluid materials, the problem of permeation of gas through the packaging can be detrimental to the material or fluid packaged. This is particularly true with certain types of foods and beverages. Similarly, the connection of the dispensing spout to the pouch material in the prior constructions, required heat sealing of similar materials which added to the gas permeation problems. Previously attempts to make a pouch of a high barrier material has been totally unsatisfactory due to the inability to connect a high barrier dispensing member thereto in a truly sealed fashion. Further, where such pouches are to be positioned in and supported by a carton or enclosing structure, the problem of providing a dispensing fitment by means of which a pouch may be securely fastened to a supporting carton added to the cost and complexity of such structures.

SUMMARY OF PRESENT INVENTION

The present invention provides a simplified fluid containing pouch construction in which the pouch has incorporated therewith a flexible top wall portion to enable ease in connecting a dispensing structure thereto. The pouch is formed of a material which has a low gas permeability and has the flexible upper wall portion sealed thereto. The dispensing structure is clamped to the flexible wall portion of the pouch apart from the dispensing passage to prevent a leakage path through the flexible upper wall portion of the pouch. The dispensing structure or neck has an annular recess in which the flexible wall portion is secured through a clamping ring to accomplish this construction. Further, the improved dispensing structure is formed to provide for connection of the pouch to a supporting carton in a simplified manner which connection will securely position the pouch therein. A supporting flange on the dispensing structure cooperates with a sleeve to secure the pouch to the carton and support the same therein. The improved pouch and carton construction provides for storage and dispensing of fluids or fluent materials while sealing the same in a relatively gas impervious structure. Further, the improved pouch construction may be readily assembled within a carton in a simplified assembly procedure.

DESCRIPTION OF PREFERRED EMBODIMENT

Figure 1:
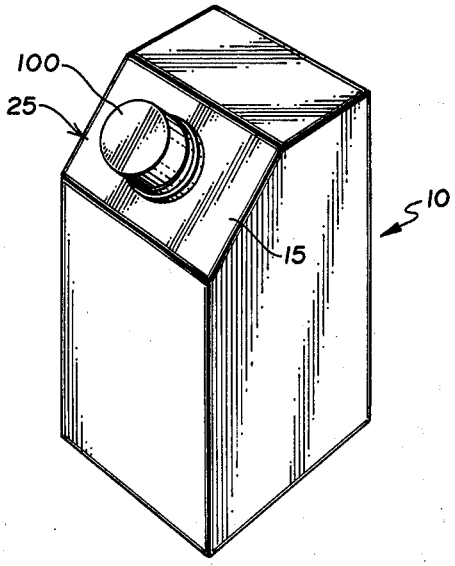
FIG. 1 is a perspective view of the improved container.

FIG. 1 shows a combination of a carton and a pouch to form a container for the storage and dispensing of fluids. The supporting carton 10 may take varying forms and preferably may be made of a paper board with sealed flaps which may be assembled in a variety of manners. Within the carton 10 is a pouch-like container 20 designed to hold the fluid in a liquid tight construction. Preferably, the carton has an inclined top wall portion 15 through which a dispensing neck 25 of the pouch extends to secure the pouch to the carton, as will be hereinafter defined. The neck 25 of the pouch is below the level of the remainder of the top wall of the carton and the side wall thereof to make the cartons readily stackable. As will be hereinafter noted, the pouch is constructed to be relatively gas impervious for the storage of fluids which might be affected by permeation of oxygen through the pouch wall.

Figure 2:
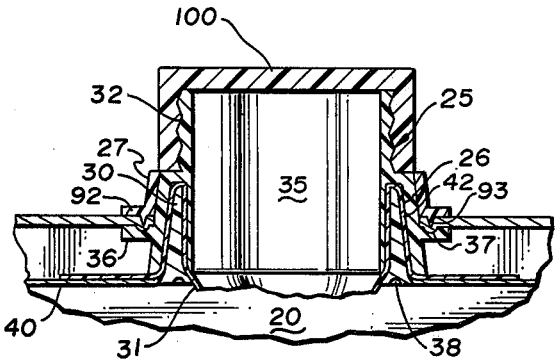
FIG. 2 is a sectional view of the pouch and carton taken along the lines 2—2 in FIG. 1.
Figure 3:
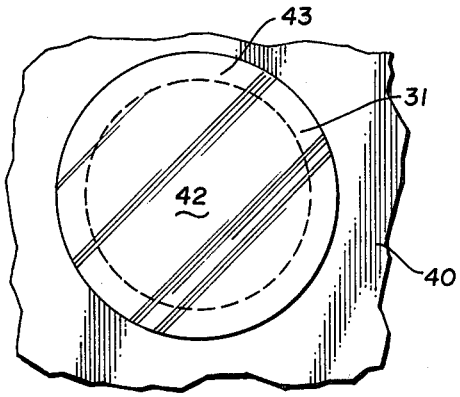
FIG. 3 is a fragmentary plan view of the pouch construction.

As will be seen in FIG. 2, the dispensing neck member 25 of the pouch 20 is attached to an upper flexible wall portion 31 by means of a recessed notch 26 in the neck member into which a collar 30 of substantially equal dimensions is positioned with the flexible wall portion 31 of the pouch positioned therebetween. The pouch is preferably constructed of a non-extensible plastic or foil material, indicated at 40 in the fragmentary plan view of FIG. 3, with the non-extendable plastic or foil having an aperture therein over which is positioned a circular piece of a flexible and extensible plastic material defining the upper flexible wall portion 31. The circular piece 31 is heat sealed to the pouch wall, as at 43, through suitable heat sealing means. The extensible plastic film forming flexible upper wall 31 of the pouch is added to the pouch for the purpose of connecting the pouch 20 to the dispensing neck 25. The size of the opening in the non-extensible portion of the pouch material 40 which is located in the top wall of the completed pouch is slightly greater than the diametrical dimension of the collar 30 for purposes to be hereinafter noted. The remainder of the pouch may be constructed in any conventional manner such as by heat sealing of the edges thereof. The resulting pouch will provide an enclosure of non-extensible plastic of foil material which is relatively gas impervious to prevent the entrance of oxygen therethrough which might affect the fluid or fluent material stored therein.

Figure 4:
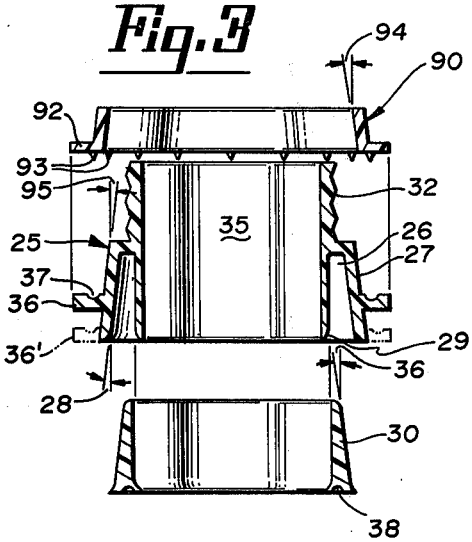
FIG. 4 is an exploded view of the parts of the dispensing assembly.
Figure 5:
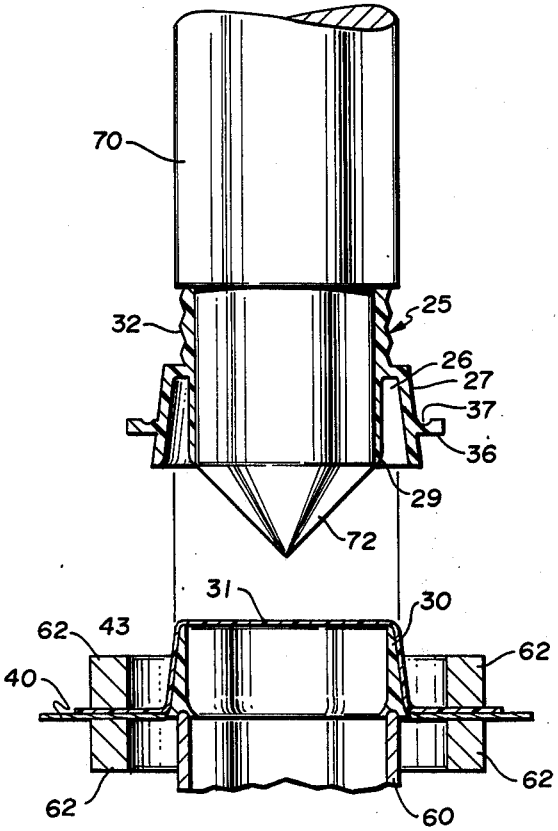
FIG. 5 is a exploded view of the parts of FIG. 4 in the assembly of the dispensing structure.

As will be seen in FIGS. 4 and 5, the dispensing neck 25 has the annular recess 26 extending from one edge thereof to form a thickened body portion having a shoulder 27 thereon. As indicated by the angle taper 28, the outer wall of the recess is tapered along its extent. Further, the lower edge of the same has a wedge shaped flare 29. The opposite end of the dispensing neck has a threaded or closure receiving surface 32 thereon with axial dimensions substantially equal to those of the recess 26, and the neck has a centrally located bore 35 extending therethrough through which fluid is dispensed. In addition, the dispensing neck includes a transversely dispensing flange section 36 which extends normal to the length of the bore 35 and has dimpled surface 37 or a grooved surface for purposes to be later noted. The flange section 36 may be located intermediate the extent of the neck or at the end thereof opposite the threaded surface 32, as shown at 36' in FIG. 4 in dotted lines.

The collar 30 is an annular member which similarly has an outer tapered surface 36 to mate with the tapered surface 28 of the annular recess. Further, it has a length or height dimension substantially equal to the depth of the recess 26. The lower edge of the annular collar has a flared extremity 38 to cooperate with the flared extremity 29 of the recess in locking the film therebetween.

As will be seen in FIG. 2, the flexible upper wall portion 31 or the extensible patch of flexible and formable plastic material on the pouch will be so fitted into the recess, through forcing of the collar thereon, that the extensible material will be deformed. The remainder of the top wall of the pouch will be closely positioned along the side of the collar so that after installation, it will be abutting the edge of the neck 25 to minimize the surface of the deformed plastic between the dispensing neck and collar. This minimizes any possible leakage path through the higher gas permeable material of wall portion 31 around the dispensing neck.

FIG. 5 shows the method of connecting the dispensing neck 25 to the pouch 20. The collar 30 is positioned on the top of a hollow forming mandrel 60 with the edges of the pouch material surrounding the opening therein in the area of the heat seal of the flexible wall portion 31 being clamped between clamping members 62. The mandrel 60 forces the collar 30 up, deforming the film of the flexible wall portion 31 around the collar 30. A mandrel 70 having a centrally located piercing member 72 is fitted into the dispensing neck 25 and next forces the neck down onto the collar with the film of the flexible wall portion therebetween. The film 31 is deformed around the collar 30 and will be forced into the annular recess 26 of the neck to be held frictionally therein by the collar 30 which will be wedged into the recess because of the tapers on the cooperating surfaces of the collar and recess. The piercing end of the mandrel 70 will pierce the extensible film surface 31 over the top of the collar from the center thereof so that it will be uniformly pierced and the edges of the same will be forced back into the pouch to curl up behind the collar and provide no obstruction to fluid passing through the dispensing neck.

If the pouch is made completely of an extensible film, then there is no need for the heat seal patch since the pouch material may be readily deformed. A patch may be utilized to reinforce the fastening of the dispensing neck if the pouch is made of a very thin film.

As will be seen in FIGS. 2, 4 and 5, a sleeve member 90 is adapted to be mounted on the shoulder portion 27 of the dispensing neck. It includes a tubular portion with an outwardly extending flange section 92, the flange section preferably having plurality spiked surfaces 93 on the edge of the same. The inner tubular surface of the sleeve is similarly tapered, as indicated by the numeral 94, to frictionally fit over a similar tapered surface, indicated at 95, on the shoulder 27 of the dispensing sleeve. The sleeve 90 is utilized to secure the pouch to a carton and cooperates with the flange section 36 to clamp the surface of the supporting carton to the dispensing neck 25. A filled or unfilled pouch may be inserted into the carton with the capped dispensing neck projecting through an aperture in the inclined top wall of the carton or in flaps forming the top wall, or in a sloped side wall near the top of the carton. The neck will be fastened to the carton by pressing the sleeve 90 onto the dispensing neck extending through the aperture in the carton with the shoulder portion 27 thereon such that the flange portion 92 will be disposed parallel to and adjacent the flange portion 36 of the dispensing neck with the carton surface therebetween. The spiked surfaces 93 of the sleeve will cooperate with the dimpled surface or groove surface 37 of the flange 36 to bite into the carton material and prevent twisting of the fitment upon removal of the cap indicated generally at 100. The cap will preferably have a threaded interior which will cooperate with the threaded surface 32 of the dispensing neck.

The construction of the improved container for fluid materials is particularly adapted for use in connection with fluids placed into the pouch at high temperatures, fluids or liquids containing alcohol and other fluid materials susceptable to the presence of oxygen. The pouch is preferably constructed of a material having a low gas permeation rate such as non-extendable plastics or foils. Such materials cannot be directly heat sealed to non-porous plastic fittings, such as the dispensing neck, and cannot be crimped to provide a positive lock with a dispensing structure. The addition of a flexible upper wall portion in the form of a extensible plastic material permits deformation of the same and locking the same into the dispensing structure or neck. The dispensing neck itself is preferably made of a thermo-plastic synthetic resin having a low gas permeation property, such as Borax 210 manufactured by the Visitron Corporation of Cleveland, Ohio. The sleeve and locking collar may be made of any thermoplastic material which is readily worked. The cap similarly would be made of a non-porous material to provide the integrity of the sealed package.

In considering this invention it should be remembered that the present disclosure is illustrative only and the scope of the invention should be determined by the appended claims.

What I claim is:

1. A container comprising: a fluid containing pouch having at least one flexible upper wall portion; a dispensing neck with a dispensing aperture extending therethrough positioned on one side of said flexible wall portion and connected thereto, said dispensing neck having an annular tapered recess surrounding said dispensing aperture at one end thereof and adjacent said flexible wall portion and a closure receiving surface on the other end thereof; a wedging collar having a corresponding tapered external surface positioned on the other side of the flexible wall portion and wedged into said annular recess of said dispensing neck with the flexible wall portion fixedly wedged therebetween and deformed around said collar in said recess so as to minimize any possible leakage path through the flexible upper wall portion around the dispensing neck, said flexible wall portion having an aperture therein communicating with the aperture in the dispensing neck, and an integral flange portion positioned on said dispensing neck and extending transversely to the aperture in said neck for mounting the pouch.

2. The container of claim 1 in which the annular recess and the wedging collar have flared extremities to aid in locking the upper wall portion of the pouch in the annular recess.

3. The container of claim 1 in which the closure receiving surface on the dispensing neck is screw threads adapted to receive a screw cap.

4. The container of claim 1 in which the liquid containing pouch has the flexible wall portion positioned adjacent the dispensing neck and the wedging collar and in which the remainder of the pouch is a comparatively non-flexible and non-porous material.

5. The container of claim 4 in which the dispensing neck is made of a thermo-plastic material having low gas permeation characteristics and in which the sleeve member and collar are made of a thermoplastic material.

6. The container of claim 1 and including a carton surrounding said pouch with said dispensing neck extending through an aperture in said carton and with said flange portion on the dispensing neck bearing against a portion of the carton surrounding said aperture and adjacent said pouch, and including a sleeve member positioned over the dispensing neck and frictionally fitted thereon bearing against the other side of said carton surrounding said aperture.

7. The container of claim 6 in which the sleeve member and the dispensing neck have cooperating tapered surfaces in the area of engagement.

8. The container of claim 6 in which the flange portion of the dispensing neck and the sleeve member have cooperating surfaces to deform the surface of the carton surrounding the aperture therein and prevent rotation of the carton relative to the pouch.

9. The container of claim 8 in which the cooperating surfaces are spiked projections and depressions arranged on said sleeve member and said flange portion respectively.

10. The container of claim 6 in which the sleeve member includes a tubular portion fitted over the side of the dispensing neck and a flange portion extending substantially parallel to the flange portion on the dispensing neck.

11. The container of claim 10 in which the tubular portion is tapered to frictionally fit on said dispensing neck.

12. The container of claim 1 in which the flange portion of the dispensing neck is positioned intermediate the ends thereof.

13. The container of claim 1 in which the flange portion of the dispensing neck is positioned adjacent the end of the neck common to the annular recess therein.

14. The container of claim 1 in which the annular recess in the dispensing neck is substantially equal in depth to the length of the cap receiving surface on the dispensing neck.

15. The container of claim 1 in which the annular recess and said wedging collar have substantially the same dimensions.

16. The container comprising: a fluid containing pouch having at least one flexible upper wall portion, a dispensing neck with a dispensing aperture extending therethrough positioned on one side of said flexible wall portion and connected thereto; said dispensing neck having an annular tapered pouch receiving recess surrounding said dispensing aperture and formed in and extending from one end thereof; and a wedging collar having a corresponding tapered external surface positioned on the side of the flexible wall portion and wedged into said annular pouch receiving recess with said flexible upper wall portion of said pouch fixedly wedged therebetween and deformed around said wedging collar in said recess so as to minimize any possible leakage path through the flexible upper wall portion around the dispensing neck, said flexible wall portion having an aperture therein within said wedging collar and communicating with the aperture in the dispensing neck.

17. The container of claim 16 in which the fluid containing pouch is comprised of the flexible upper wall portion coupled to a non-flexible material having low gas permeation properties.

18. The container of claim 16 and including a carton having an aperture therein surrounding said pouch with said dispensing neck of said pouch extending through the aperture in the carton; and including means positioned on said dispensing neck and engaging opposite sides of said carton surrounding said aperture for retaining said pouch in said carton.

19. The container of claim 18 in which the means on said dispensing neck includes an integral flange structure extending transverse of the aperture in the dispensing neck and a removable sleeve member telescopically fitted over the dispensing neck and frictionally secured thereon.

* * * * *